United States Patent [19]

Kreuter

[11] Patent Number: 4,819,586

[45] Date of Patent: Apr. 11, 1989

[54] CRACKING FURNACE WITH IMPROVED HEAT TRANSFER TO THE FLUID TO BE CRACKED

[75] Inventor: Walter Kreuter, Penzberg, Fed. Rep. of Germany

[73] Assignee: Linde Aktiengesellschaft, Wiesbaden, Fed. Rep. of Germany

[21] Appl. No.: 144,877

[22] Filed: Jan. 13, 1988

[30] Foreign Application Priority Data

Jan. 16, 1987 [DE] Fed. Rep. of Germany ..... 3701161

[51] Int. Cl.[4] ..... F22B 15/00

[52] U.S. Cl. ..... 122/235 C; 122/DIG. 13; 165/177; 196/110; 196/116; 422/201

[58] Field of Search ..... 122/235 C, 235 K, DIG. 13, 122/511; 165/177; 196/116, 110; 422/201

[56] References Cited

U.S. PATENT DOCUMENTS

| | | | |
|---|---|---|---|
| 3,572,999 | 3/1971 | Sato | 122/235 C X |
| 3,964,873 | 6/1976 | Aramaki et al. | 165/177 X |
| 4,160,701 | 7/1979 | Dorner et al. | 122/235 C |
| 4,466,479 | 8/1984 | Maclean | 165/177 X |

*Primary Examiner*—Edward G. Favors
*Attorney, Agent, or Firm*—Herbert Dubno

[57] ABSTRACT

A cracking furnace for naphtha and other hydrocarbons or, in general, for the rapid heating of a fluid feed stack has one or more tubular elements satisfying the following conditions: $d_h 32\ F/U \leqq 40mm$, and $D/d \geqq 2$, wherein: $d_h$=the hydraulic diameter of the flow passage defined as the ratio of the flow cross-sectional area to the inner peripheral dimension therearound; F=the flow cross-sectional area; U=the inner peripheral dimension of the flow cross section; d=the cross-sectional height of the flow cross section; and D=the width of the flow cross section.

13 Claims, 1 Drawing Sheet

CRACKING FURNACE WITH IMPROVED HEAT TRANSFER TO THE FLUID TO BE CRACKED

FIELD OF THE INVENTION

My present invention relates to a furnace and, more particularly, to a furnace for the heat transfer to a fluid traversing a radiation zone of the furnace through at least one tubular element forming a flow passage for the fluid.

Specifically the invention relates to a cracking furnace of the type in which the radiation zone is defined by burners in a furnace chamber and at least one and generally plurality of tubular elements traverse this chamber to maximize the heat transfer from the burners to the fluid.

BACKGROUND OF THE INVENTION

Furnaces for the thermal cracking of hydrocarbons, for example naphtha, are known and generally comprise a burner-heated radiation zone within the furnace chamber.

The hydrocarbons to be cracked are conducted through the radiation zone in one or a plurality of parallel tubular elements.

The reaction kinetics show that the cracking effect is greatly dependent upon the temperature to which the hydrocarbons are heated, and the residence time of the hydrocarbons in the radiation zone. For olefin formation, it is, for example, essential that the reaction energy be delivered at the highest possible rate to the hydrocarbons, meaning that the residence time of the hydrocarbons in the radiation zone should be minimized.

The short residence times ensures a suppression of undesired side reactions and allows maximum temperatures to be used. In general, therefore, it is desirable to provide conditions which combine maximum temperature, minimum resonance time and maximum yield or conversion to obtain the highest reaction efficiency.

Since a given permissible pressure drop and a maximum permissible tube-wall temperature cannot be exceeded, from the fact that the heating surface is proportional to the tube diameter and the throughput is proportional to the square of the diameter, the conclusion that for the brief residence time, small tubes of small throughput should be used.

In conventional furnaces for this purpose, it is not uncommon to use tubes with an internal diameter of about 25 mm and lengths of about 10 m. Such furnaces can be of the type described in German printed application DE-AS No. 18 09 177.

A further increase in the yield over that which has been obtainable with such furnaces has posed problems since an increase in the temperature or a further reduction in the residence time requires use of tubing with smaller bores, i.e. small caliber tubing. Smaller caliber tubing, however, at operating temperatures of the order of 1100° C. does not have the required stiffness and in addition creates a problem of blockage by carbon deposits within the tubing, i.e. as a result of the coking effect.

OBJECTS OF THE INVENTION

It is the principal object of the present invention to provide a furnace with improved heat transfer to a fluid traversing a tube element within the heated furnace chamber.

Another object of my invention is to provide a cracking furnace which affords increased yield over the furnace described above without encountering problems with strength of the tubing elements or blockage by coking. It is also an object of this invention to overcome the drawbacks outlined above and which can crack hydrocarbons at very short residence times while nevertheless providing sufficient strength of the tubular elements traversed by the fluid.

SUMMARY OF THE INVENTION

These objects and others which will become apparent hereinafter are attained, in accordance with the invention, in a furnace for heat transfer to a fluid and particularly a cracking furnace, which comprises a housing defining at least one furnace chamber, heaters, e.g. burners, in this chamber defining a radiant heating zone therein, and at least one tubular element traversing the radiant heating zone and provided with means for freeing a fluid, e.g. hydrocarbons to be cracked to the tubular element and means for removing the heated fluid therefrom.

According to this invention, each tubular element satisfies the following criteria:

$$d_h = 4F/U \leqq 40 \text{ mm}$$

and $$D/d \leqq 2.$$

In these relations, $d_h$ represents the hydraulic diameter of the flow cross section which is defined as the ratio F of the flow cross sectional area of the passage of the tubular element to the internal periphery or circumference U bounding the flow cross section of this passage.

The tubular element thus defines a flow passage for the fluid which has a cross sectional width greater than a cross sectional height thereof and in these relations the cross sectional height is represented at d and the width at D.

The furnace has one or more such tubular elements, therefore, whose widths are more than twice the heights of the flow cross sections with the hydraulic diameter nevertheless being maintained at most at 40 mm.

I have found, quite surprisingly, that this combination of features provides an especially short residence time while nevertheless guaranteeing that the tubular elements will have a high stiffness and capacity to be subject to high temperatures and pressures. Furthermore, under these conditions, the tubular elements have very small tendency to vibrate.

The furnace of the invention is especially effective for carrying out endothermic reactions, especially the cracking of hydrocarbons and particularly the stream cracking of hydrocarbons such as naphtha to produce olefins.

In one preferred embodiment of the invention, the flow cross section of the passage of the tubular element has a substantially rectangular cross section.

In another preferred embodiment, the flow cross section is defined by at least two and preferably three or more partial flow cross sections which adjoin each other and are each partly elliptical, the elliptical cross sections adjoining one another along the major axis of the respective ellipses. In this case, d represents the height of the ellipse, i.e. the dimension along the minor axis, while D represents the width of the interconnected ellipses, i.e. the total width of the passage measured along the major axis of the ellipses.

In a further preferred embodiment, the flow cross section has a meander pattern transversely of the tube in which case d represents the shortest dimension, namely, the shortest spacing between two juxtaposed walls pounding the passage while D represents essentially the distance between the ends of the meander.

The tube or tubes which can be used can be straight or can themselves form a meander and can have lengths between 3 m and 12 m, preferably between 3 m and 9 m, advantageously measured between the inlet and outlet means connected with such tubes. The inlet and outlet means can be manifold piping.

The tubular elements themselves can be composed of metal and for this purpose any metal which has been used heretofore in cracking furnaces can be employed. Ceramic materials and especially fiber-reinforced ceramic materials can also be used.

The tubular elements can be formed by casting, extrusion or die-casting techniques, but it has also been found to be advantageous to mill the tubular element from a block or billet of metal. A tubular element thus formed from a block is found to have especially high stability with respect to deformation and is capable of sustaining very high temperatures and pressures.

According to another feature of the invention, the tubular element can be assembled from two embossed plates which are welded together, the embossing forming channels which collectively define the flow passage when the plates are joined and each pair of plates when joined together can form interconnected flow passages or a plurality of separate flow passages which do not communicate with one another.

According to another feature of the invention, a plurality of such tubular elements are arranged in mutually adjacent relationship, preferably with a vertical orientation.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
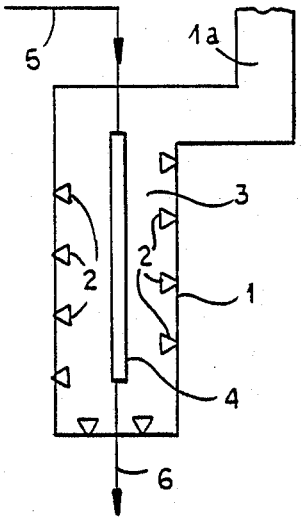
FIG. 1 is a diagram of a cracking furnace utilizing tubular elements in accordance with the invention.

In FIG. 1 of the drawing I have shown a cracking furnace which has been illustrated only in highly diagrammatic form. The apparatus comprises a furnace housing 1 defining at least one chamber 3 which also forms a radiant heating zone, the radiant heating being provided with a plurality of burners 2 arrayed along the walls of the furnace in this zone. A stack 1*a* vents combustion products from the burners. At least one, and preferably a plurality of mutually parallel transversely spaced tubular elements 4, are provided in this zone and are so juxtaposed with the burners as to be heated thereby to transfer such heat to a hydrocarbon or other fluid which is fed through the tubular elements 4 by an inlet means represented by the line 5. The reaction products and/or heated fluid is discharged as represented by the line 6 Within the tubular elements 4, an endothermic reaction is effected such as cracking to form olefins.

The flow direction has been represented by arrowheads in FIG. 1, although it will be understood that the opposite flow direction can also be used.

Each tubular element 4 has a hydraulic diameter d of at most 40 mm and preferably between 10 mm and 30 mm as well as a quotient between the breadth D of the flow passage and the height d of the flow passage of at least 2.

Figure 6:
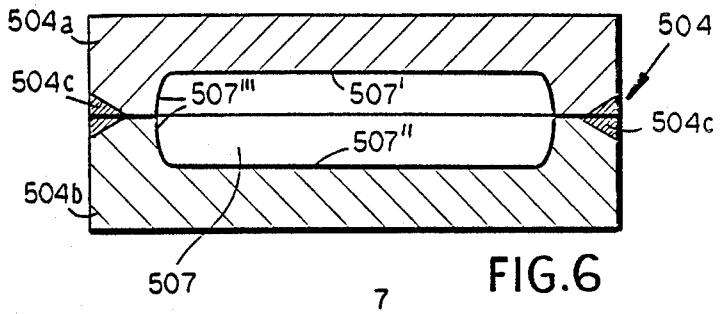
FIG. 6 is still another cross section showing the formation of the flow passage from two milled blocks.
Figure 2:
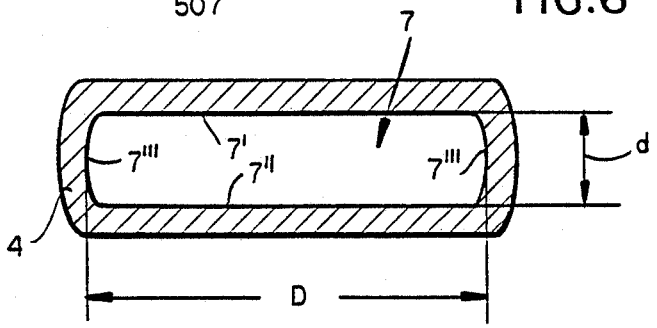
FIG. 2 is a cross section through a tubular element of rectangular cross section according to one embodiment of the invention.

In FIGS. 2 and 6, the flow passage 7, 507 has a generally rectangular cross section defined between a pair of parallel broad sides 7', 7'' and 507', 507''. The ends of these cross sections at 7''' and 507''' can be slightly rounded with an inward convexity. In these embodiments, the tube 4 forming the flow passage (FIG. 2) can be extruded from metal or from a ceramic or a fiber-reinforced ceramic, e.g. an alumina reinforced with silica fibers.

The breadth D of the flow passage can be abut 60 mm and the height d about 20 mm which corresponds to a hydraulic diameter $d_h$ of 30 mm and a quotient D/d of 3. The tubular structure 504 shown in FIG. 6 is made from two halves 504*a*, 504*b*, each of which is milled to form a respective half of the flow passage from a metal block. The two halves are then joined together by welds 504*c*.

Figure 3:
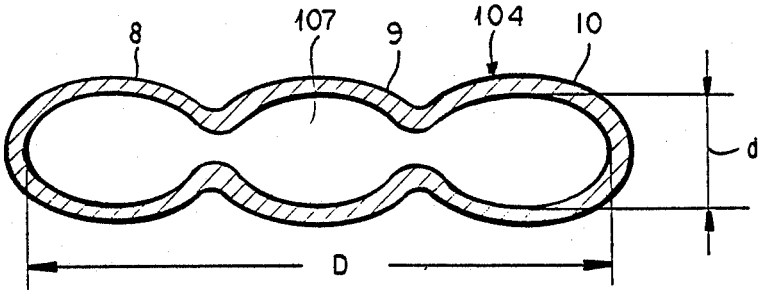
FIG. 3 is a cross section through another embodiment of the invention in which the flow passage is defined by three interconnected ellipsoidal sections.

FIG. 3 shows a tubular element 104 which is composed of three segments 8, 9, 10, each of which has a generally ellipsoidal cross section with the sections being joined along the major diameters of the ellipses. These sections form a common flow passage 107. The height of the flow passage 107 is in this case formed by the height d of the ellipses and corresponds to the dimension along the minor axis thereof. The breadth or width d corresponds to the total width of the three interconnected ellipses. d amounts to between 10 and 40 mm and D is between 30 and 120 mm.

Figure 4:
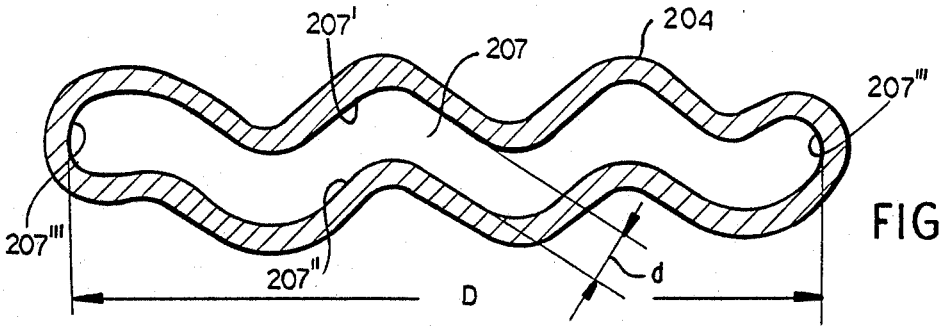
FIG. 4 is a cross section through a tubular element having a meander flow cross section.

The tubular element 204 of FIG. 4 forms a meander-shaped flow passage 207 in cross section. The height d is here the smallest distance between the juxtaposed boundary walls 207', 207'' of the meander while the distance D is the distance between the ends 207''' thereof. D also is between 30 and 120 mm, while d is between 8 and 35 mm.

Figure 5:
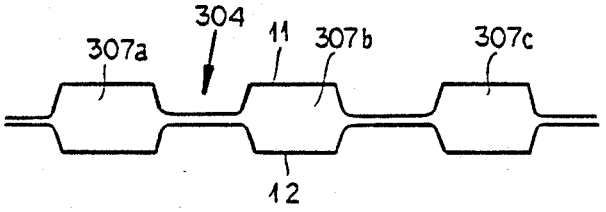
FIG. 5 is a diagram showing how two embossed plates can be assembled together to form a tubular element according to the invention.

FIG. 5 diagrammatically illustrates a tubular element 304 formed by two embossed sheet metal plates 11 and 12 which are provided with rectangular embossments or corrugations and are welded together in mirror-symmetrical relationship to define closed flow passages 307*a*, 307*b* and 307*c*. Of course flow passages of the configuration shown in FIGS. 3 or 4 can also be used in place of the generally rectangular flow cross section of FIG. 5. The dimensions of each of the rectangular flow passages can correspond to those of the tube 4 in FIG. 2.

SPECIFIC EXAMPLE

A furnace for the steam cracking of naphtha to olefins with throughput of 12 metallic tons per hour of the hydrocarbon is provided with 80 tubular elements of the type illustrated in FIG. 4 with lengths of 5 m. The radiant heating zone was heated to a temperature of about 1100° C. The hydrocarbon was fed at the inlet ends of the tubes at a temperature of 620° C. and left the tubes at a temperature of 925° C. after a residence time amounting to 0.4 seconds. The tubular elements had dimensions d=8 mm, D=75 mm, $d_h$=12.7 mm and D/d=9.3.

I claim:

1. A furnace for transferring heat to a fluid, comprising:

a housing defining at least one furnace chamber;

heaters in said chamber defining a radiant-heating zone therein; and at least one tubular element traversing said radiant-heating zone and provided with means for feeding said fluid to said tubular element and with means for removing said fluid from said tubular element so that said fluid is heated as it passes through said tubular element, said tubular element defining a flow passage for said fluid having a cross-sectional width greater than a cross-sectional height thereof, each said tubular element satisfying the following criteria:

$d_h = F/U \leqq 40$ mm, and $D/d \geqq 2$, wherein:

$d_h$=the hydraulic diameter of the flow passage defined as the ratio of the flow cross-sectional area to the inner peripheral dimension therearound;

F=the flow cross-sectional area;

U=the inner peripheral dimension of the flow cross section;

d=the cross-sectional height of the flow cross section; and

D=the width of the flow cross section;

wherein said flow passage has a meander-shaped cross section such that d is equal to the smallest distance between juxtaposed walls bounding the flow cross section and D corresponds to the distance between ends of the meander-shaped cross section.

2. The furnace defined in claim 1 wherein said flow passage has, in cross section, a plurality of generally elliptical sections joining each other along major axes of the respective ellipses, d, corresponding to the height of the ellipses, and D, corresponding to the width of the interconnecting ellipses.

3. The furnace defined in claim 1 wherein said element has a length between substantially 3 mm and 12 mm.

4. The furnace defined in claim 1 wherein said tubular element is composed of a metallic material.

5. The furnace defined in claim 1 wherein said tubular element is composed of a ceramic material.

6. The furnace defined in claim 1 wherein said tubular element is composed of a fiber-reinforced ceramic material.

7. The furnace defined in claim 1 wherein said tubular element is a cast structure.

8. The furnace defined in claim 1 wherein said tubular element is an extrusion pressed structure.

9. The furnace defined in claim 1 wherein said tubular element is formed from a block.

10. The furnace defined in claim 1 wherein said tubular element is assembled from two embossed plates which are welded together.

11. The furnace defined in claim 1 wherein a plurality of tubular elements in mutually parallel relationship are provided in said radiant heating zone

12. The furnace defined in claim 1 wherein said furnace is a cracking furnace for the cracking of hydrocarbons to olefins and is maintained at a temperature sufficient for the cracking of said hydrocarbon.

13. The furnace defined in claim 1 wherein said meander-shaped cross section includes at least four inwardly facing concave curves.

* * * * *